US012508463B2

(12) United States Patent
Liu

(10) Patent No.: US 12,508,463 B2
(45) Date of Patent: Dec. 30, 2025

(54) DUMBBELL CAPABLE OF ADJUSTING WEIGHT RAPIDLY, AND DUMBBELL ASSEMBLY

(71) Applicant: OHFG TECHNOLOGIES(SHANGHAI) CO., LTD, Shanghai (CN)

(72) Inventor: Ping Liu, Shanghai (CN)

(73) Assignee: OHFG TECHNOLOGIES(SHANGHAI) CO., LTD, Shanghai (CN)

( * ) Notice: Subject to any disclaimer, the term of this patent is extended or adjusted under 35 U.S.C. 154(b) by 167 days.

(21) Appl. No.: 18/500,947

(22) Filed: Nov. 2, 2023

(65) Prior Publication Data

US 2025/0099803 A1 Mar. 27, 2025

(30) Foreign Application Priority Data

Sep. 27, 2023 (CN) ..... 202311269153.1

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01)

(58) Field of Classification Search
CPC ..... A63B 21/0726; A63B 21/072–075
See application file for complete search history.

(56) References Cited

U.S. PATENT DOCUMENTS

| | | | | |
|---|---|---|---|---|
| 7,011,611 | B1 * | 3/2006 | Ripley | A63B 21/0728 482/107 |
| 7,172,536 | B2 * | 2/2007 | Liu | A63B 21/075 482/93 |
| 9,950,205 | B2 * | 4/2018 | Simonetti | A63B 21/0632 |
| 10,974,093 | B2 | 4/2021 | Wang | |
| 11,219,795 | B1 | 1/2022 | Yao | |
| 11,484,745 | B1 | 11/2022 | Weng | |
| 11,717,714 | B1 | 8/2023 | Hong | |
| 2005/0233873 | A1 | 10/2005 | Chen | |
| 2009/0048079 | A1 * | 2/2009 | Nalley | A63B 21/0728 482/107 |
| 2019/0299047 | A1 * | 10/2019 | Nalley | A63B 21/0726 |
| 2019/0388723 | A1 * | 12/2019 | Nalley | A63B 21/0604 |
| 2024/0366989 | A1 * | 11/2024 | Hara | A63B 21/075 |
| 2024/0408434 | A1 * | 12/2024 | Liu | A63B 71/0036 |

* cited by examiner

*Primary Examiner* — Megan Anderson
*Assistant Examiner* — Catrina A Letterman

(57) ABSTRACT

Provided is a dumbbell capable of adjusting weight rapidly, including a dumbbell rod assembly and dumbbell plates. Hitching assemblies are arranged at two ends of the dumbbell rod; a first baffle is arranged at one end of each of the hitching assemblies; a concave inserting-connection port is formed at the top of each of the dumbbell plates; the dumbbell plates are hitched to the hitching assemblies; the dumbbell sheets are provided with first hitching parts and second hitching parts; a second surface of one dumbbell plate close to the first baffle abuts against the first baffle, and the second hitching parts of the other dumbbell sheets are hitched to the first hitching parts of the adjacent dumbbell plate; and a bolt is inserted into a bolt through hole of the dumbbell plate farthest from the first baffle.

15 Claims, 12 Drawing Sheets

DUMBBELL CAPABLE OF ADJUSTING WEIGHT RAPIDLY, AND DUMBBELL ASSEMBLY

TECHNICAL FIELD

The present disclosure relates to the technical field of fitness equipment, and in particular to a dumbbell capable of adjusting weight rapidly, and a dumbbell assembly.

BACKGROUND

A dumbbell is one of the most popular fitness equipment, including an integrated dumbbell and an assembled dumbbell. The assembled dumbbell is small in volume and adjustable in weight, and is more suitable for daily muscle strength exercise equipment at home. At present, the traditional assembled dumbbell has a dumbbell rod and dumbbell plates. The weight of the dumbbell is adjusted by adjusting the number of the dumbbell plates on the dumbbell rod, thereby switching the training intensity. However, when a common dumbbell changes the dumbbell plate, it is necessary to replace fixing pieces at two ends and then remove the dumbbell plates, which is very troublesome. In addition, an improper operation may cause the dumbbell plate to hurt the foot or damage the ground. Thirdly, there are some traditional dumbbells. Only one dumbbell plate can be mounted on each side. In a case that the weight is required to be adjusted, it is necessary to buy a plurality of dumbbell plates with different weights, so the cost is higher.

SUMMARY

An objective of the present disclosure is to provide a dumbbell capable of adjusting weight rapidly, and a dumbbell assembly, thereby overcoming the defects in the prior art.

To achieve the above objective, the present disclosure provides the following technical solution:

a dumbbell capable of adjusting weight rapidly includes a dumbbell rod assembly and a plurality of dumbbell plates, where the dumbbell assembly includes a dumbbell rod; a concave inserting-connection port is formed at the top of each of the dumbbell plates; each of the dumbbell plates includes a first surface and a second surface which are arranged oppositely, the first surface is provided with at least one first hitching part, the second surface is provided with a second hitching part hitched to and matched with the at least one first hitching part, and a first bolt hole and a second bolt hole are formed at the top of each of the dumbbell plates and on two sides of the inserting-connection port; the dumbbell rod assembly further includes hitching assemblies arranged at two ends of the dumbbell rod; each of the hitching assemblies includes a bridge block, the bridge block is matched with the inserting-connection port of each of the dumbbell plates, one end of the bridge block is fixedly connected to a first baffle, a plurality of bridge block through holes are formed at the top of the bridge block, and after each of the dumbbell plates is in inserting connection with the bridge block, the first bolt hole, the second bolt hole and the corresponding bridge block through hole form a bolt channel; the dumbbell further includes a bolt which is inserted into the bolt channel and can hitch the dumbbell plate of the bolt channel to the hitching assembly; the plurality of selected dumbbell plates are in inserting connection with the hitching assembly at any end the second surface of the dumbbell plate close to the first baffle abuts against the first baffle, and the second hitching parts of the rest of dumbbell plates are hitched to the first hitching part of the adjacent dumbbell plate; and the bolt is inserted into the bolt channel of the dumbbell plate farthest from the first baffle.

In some embodiments, a first hitching part is arranged on at least one of two sides of the inserting-connection port of the first surface of the dumbbell plate; and the second surface of the dumbbell plate is provided with a second hitching part matched with the first hitching part.

In some embodiments, the first hitching part is a convex strip formed by the first surface extending outwards; the second hitching part is a groove formed by the second surface extending inwards, and a first end of the groove in a length direction extends upwards to a top surface of each of the dumbbell surface; and when two adjacent dumbbell plates are hitched, the convex strip of one dumbbell plate is embeddable into the groove of the other dumbbell plate, and a second end of the convex strip in a length direction abuts against a second end of the groove in the length direction.

In some embodiments, the bolt includes a bolt head and a bolt rod, and a first end of the bolt rod is fixedly connected to the bolt head.

In some embodiments, a mounting groove for accommodating the bolt head is formed at an outer port of the first bolt hole or the second bolt hole of the dumbbell plate, and a shape of the mounting groove is matched with that of the bolt head, so that the bolt head is mountable in the mounting groove.

In some embodiments, a storage through hole is formed at the bottom of the hitching assembly, and the bolt is inserted into the bridge block through the storage through hole for storage of the bolt.

In some embodiments, a grip sleeve is sleeved on an outer side of a grip of the dumbbell rod.

A dumbbell assembly includes the dumbbell, and a tray for placing the dumbbell.

In some embodiments, groove structures are arranged at the bottoms of the first surface and the second surface of the dumbbell plate; a plurality of inserting-connection plates are arranged at the top of the tray, and protruding structures matched with the groove structures are arranged at the tops of the inserting-connection plates; and the dumbbell plate is inserted between the two adjacent inserting-connection plates.

In some embodiments, a plurality of anti-skid pads are arranged at the bottom of the tray.

In some embodiments, the dumbbell assembly is provided with a locking mechanism; the locking mechanism comprises a limiting plate arranged in the hitching assembly, and a limiting clamping port arranged on the bolt rod of the bolt; and the locking mechanism enables the bolt to be locked or released on the hitching assembly through a clamping relationship between the limiting plate and the limiting clamping port.

In some embodiments, a limiting rod is arranged at at least one of two ends of the limiting plate, a first end of the limiting rod is fixedly connected to the limiting plate, and a second end of the limiting rod vertically penetrates through the hitching assembly; and a limiting protruding block corresponding to the limiting rod is arranged at the top of the tray, and the locking mechanism is locked or released through the cooperation of the limiting protruding block and the limiting rod.

Compared with the prior art, the present disclosure adopts a hitching relationship between the bolt and the dumbbell plate to fix the dumbbell at the hitching assembly, and adjusts the weight of the dumbbell through cooperation between the bolt and the dumbbell plates at different positions. Compared with the traditional dumbbell, the present application is more convenient to operate and simpler to use. In addition, according to the present application, a locking mechanism is provided, and locking or releasing between the bolt and the dumbbell rod assembly can be controlled, thereby avoiding the risk that the dumbbell plate falls off caused by the bolt sliding out at will during use of the dumbbell. Thirdly, the left and right ends of the dumbbell of the present application can be adjusted independently, and the corresponding weight can be adjusted according to actual requirements.

BRIEF DESCRIPTION OF THE DRAWINGS

The drawings of the specification that constitutes a part of the present application are used to provide a further understanding of the present invention. The exemplary embodiments of the present disclosure and the description thereof are used to explain the present invention, and do not constitute an improper limitation of the present invention. In the drawings.

Figure 1:
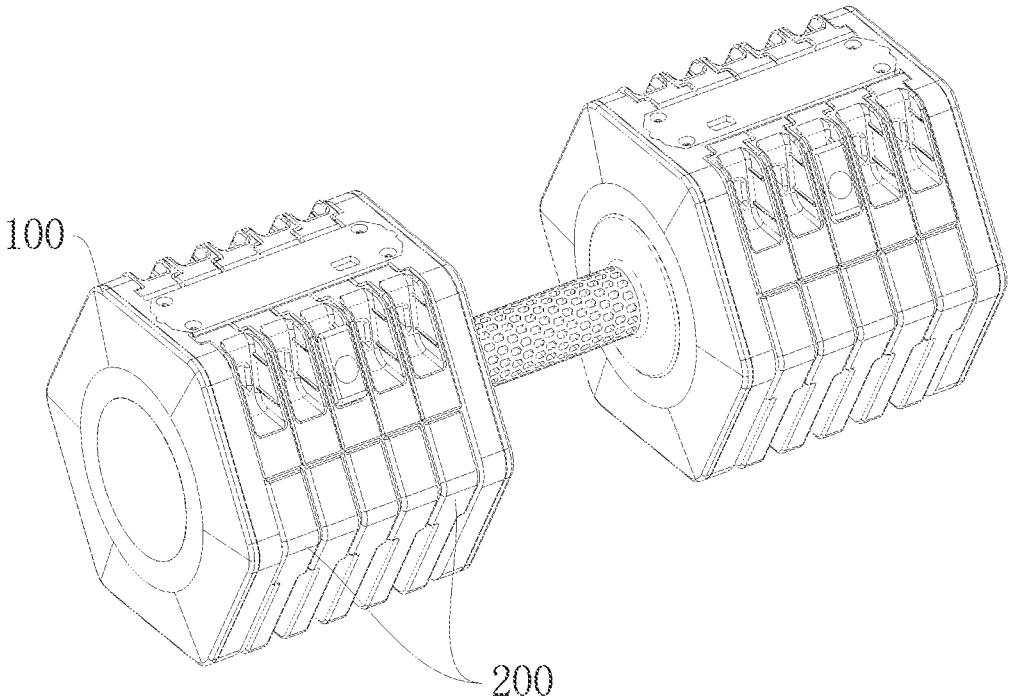
FIG. 1 is an overall structural schematic diagram of a dumbbell according to an embodiment of the present invention.

Description of reference numerals: 1—dumbbell; 100—dumbbell rod assembly; 110—hitching assembly; 1101—left-side hitching assembly; 1102—right-side hitching assembly; 111—first baffle; 112—second baffle; 113—bridge block; 1131—bridge block through hole; 1132—storage through hole; 120—dumbbell rod; 1201—grip sleeve; 200—dumbbell plate; 201—first dumbbell plate; 202—second dumbbell plate; 203—third dumbbell plate; 210—first surface; 211—first hitching part; 212, 222—groove structure; 220—second surface; 221—second hitching part; 230—inserting-connection port; 240—bolt through hole; 241—first bolt hole; 242—second bolt hole; 300—bolt; 301—first bolt; 302—second bolt; 310—bolt head; 320—bolt rod; 321—limiting clamping port; 400—locking assembly; 410—limiting plate; 411—limiting groove; 420—limiting rod; 430—limiting protruding block; 440—limiting spring; 2—tray; 21—inserting-connection plate; 22—anti-skid pad.

DETAILED DESCRIPTION OF THE EMBODIMENTS

The present disclosure will be described in detail below with reference to the accompanying drawings and in conjunction with embodiments. Various examples are provided by way of interpretation of the present disclosure and are not intended to limit the present invention. Indeed, it will be apparent to those skilled in the art that modifications and variations may be made in the present disclosure without departing from the scope or spirit of the present invention. For example, features shown or described as part of one embodiment may be used in another embodiment to produce yet another embodiment. Therefore, it is desirable that the present disclosure includes such modifications and variations falling within the scope of the appended claims and their equivalents.

In the description of the present invention, the terms "longitudinal", "transverse", "up", "down", "front", "back", "left", "right", "vertical", "horizontal", "top", "bottom" and the like denote orientation or positional relationships based on those shown in the drawings and are intended for ease of description only and not to require that the present disclosure is necessarily constructed and operated in a particular orientation and therefore cannot be construed as limiting to the present invention. The terms "connection", "connect" and "set" used in the present disclosure should be understood in a broad sense, for example, which may refer to a fixed connection or a detachable connection; which may refer to a direct connection or an indirect connection through intermediate components; which may refer to a wired electrical connection, a radio connection, or a wireless communication signal connection, and the specific meanings of the above terms may be understood by those of ordinary skill in the art according to a specific situation.

One or more examples of the present disclosure are shown in the accompanying drawings. The detailed description uses numeric and letter marks to refer to features in the drawings. Similar or like reference signs in the drawings and descriptions have been used to refer to similar or like parts of the present invention. As used herein, the terms "first", "second" and "third" and the like are used interchangeably to distinguish one member from another and are not intended to denote the location or importance of individual members.

Figure 2:
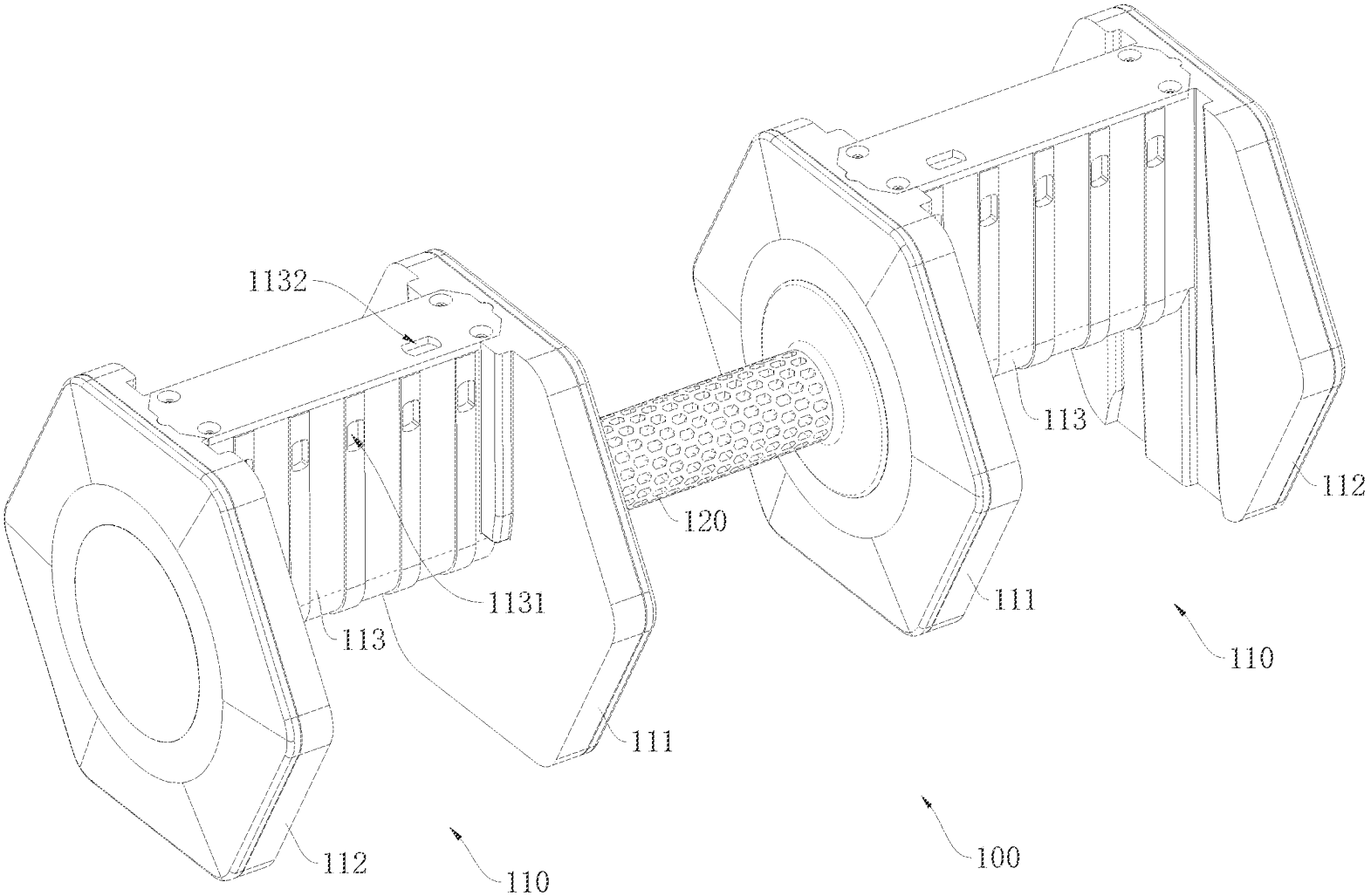
FIG. 2 is a structural schematic diagram of a dumbbell rod assembly according to an embodiment of the present invention.

Referring to FIG. 1 and FIG. 2, according to the embodiments of the present invention, a dumbbell 1 capable of adjusting weight rapidly is provided, including a dumbbell rod assembly 100 and a plurality of dumbbell plates 200. The dumbbell rod assembly 100 includes a dumbbell rod 120, and hitching assemblies 110 fixedly connected to two ends of the dumbbell rod 120. The dumbbell plates 200 are hitched to the hitching assemblies 110.

Referring to FIG. 3 to FIG. 7, each of the dumbbell plates 200 includes a first surface 210, and a second surface 220 opposite to the first surface 210. A radially concave V-shaped inserting-connection port 230 is formed at the top of the dumbbell plate 200, and the dumbbell plate 200 is in inserting connection with the hitching assembly 110 through the cooperation of the inserting-connection port 230.

The first surface 210 of the dumbbell plate 200 is provided with a first hitching part 211, and the second surface 220 of the dumbbell plate 200 is provided with a second hitching part 221 matched with the first hitching part 211. The two adjacent dumbbell sheets 200 are hitched to each other through the first hitching part 211 and the second hitching part 221 which are adjacent to each other.

Specifically, the first hitching parts 211 are arranged on two sides of the inserting part 230 of the first surface 210 of the dumbbell plate 200, respectively; and the second hitching parts 221 matched with the first hitching parts 211 are arranged on two sides of the inserting-connection port 230 of the second surface 220 of the dumbbell plate 200, respectively. Further, the first hitching part 211 is a convex strip formed by the first surface 210 extending outwards, and a first end in a length direction of the convex strip extends upwards to a top surface of the dumbbell sheet 200. The second hitching part 221 is a groove formed by the second surface 220 extending inwards, and a first end in a length direction of the groove extends upwards to the top surface of the dumbbell plate 200. The convex strip is matched with the groove, so that when the two adjacent dumbbell plates 200 are attached to each other, the convex strip of one dumbbell plate 200 can be embedded into the groove of the other dumbbell sheet 200, and a second end in the length direction of the convex strip abuts against a second end in the length direction of the groove, so that the two dumbbell plates 200 are hitched to each other.

Figure 3:
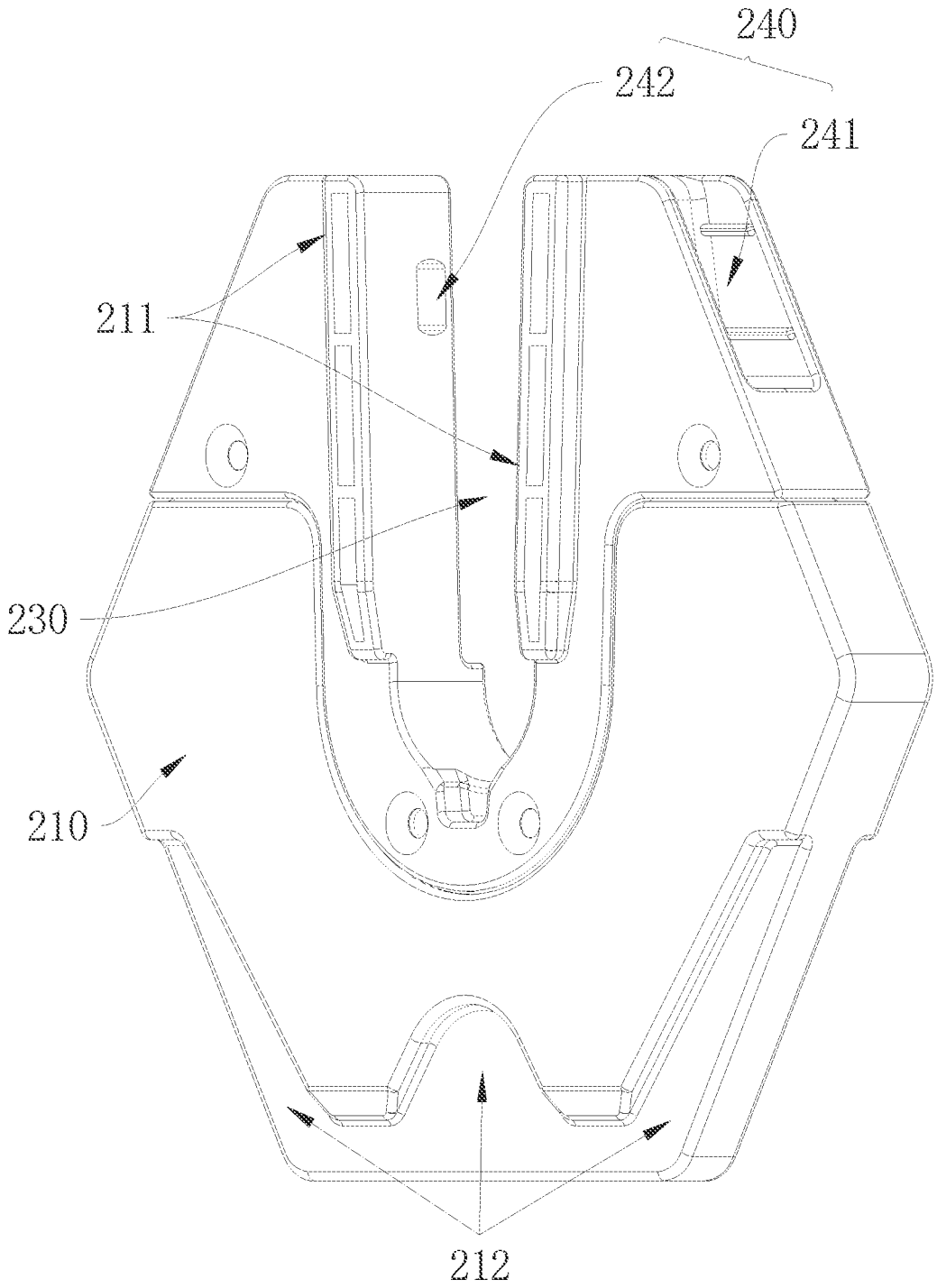
FIG. 3 is a three-dimensional structural schematic diagram of a first surface of a dumbbell plate according to an embodiment of the present invention.

Referring to FIG. 3, a bolt through hole 240 is formed at the top of the dumbbell plate 200, and the bolt through hole 240 penetrates from one side of the first surface 210 of the dumbbell plate 200 to the other side. A middle part of the bolt through hole 240 is broken by the inserting-connection port 230 and is divided into a first bolt hole 241 and a second bolt hole 242.

Figure 8:
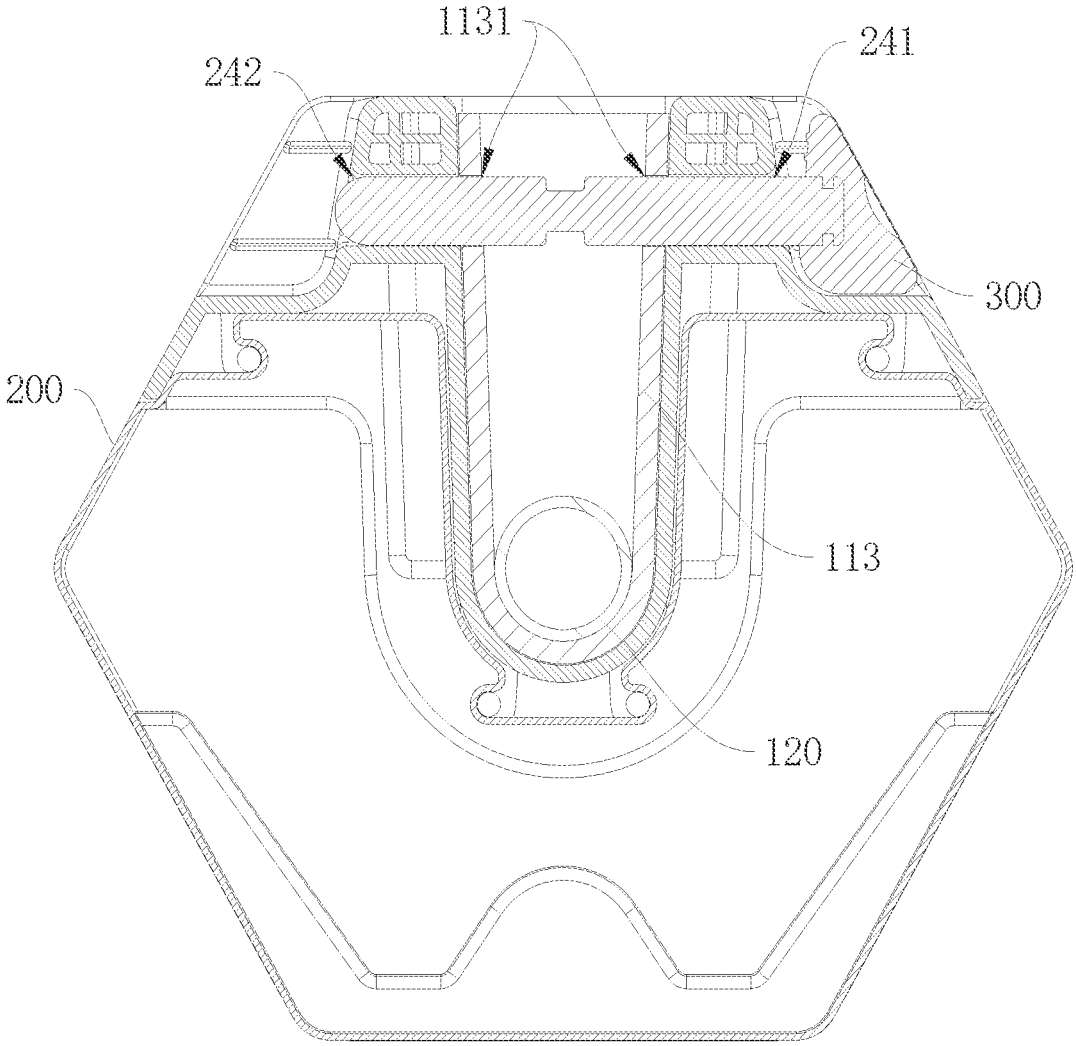
FIG. 8 is a schematic diagram of a sectional structure of a dumbbell plate hitched to a bridge block according to an embodiment of the present invention.

Referring to FIG. 2 and FIG. 8, the hitching assembly 110 includes a first baffle 111 and a second baffle 112, and a bridge block 113 arranged between the first baffle 111 and the second baffle 112. The cross section of the bridge block 113 has a V-shaped structure matched with the V-shaped inserting-connection port 230 of the dumbbell plate 200. The V-shaped structure has the following advantages: the dumbbell plate 200 is in inserting connection with the bridge block 113 easily, and after the inserting connection, the dumbbell plate 200 is more attached to the bridge block 113, so that a gap between the dumbbell plate 200 and the bridge block 113 can be eliminated or reduced as much as possible.

The bridge block 113 is provided with a plurality of bridge block through holes 1131. Generally, the number of the bridge block through holes 1131 is the same as the number of the dumbbell plates 200 that can be hitched to the bridge block 113. After the inserting-connection port 230 of the dumbbell plate 200 is inserted into the bridge block 113 and is completely attached, the bridge block through hole 1131 fills the missing part between the first bolt hole 241 and the second bolt hole 242 and constructs a bolt channel. The bolt 300 is inserted from one side of the bolt hole 241, penetrates through the bridge block through hole 1131 and penetrates out of one side of the second bolt hole 242. At this time, the dumbbell plate 200 is hitched to the bridge block 113 through the bolt 300.

Of course, it is unnecessary for the bolt through hole 240 to penetrate through the dumbbell plate 200. For example, the first bolt hole 241 of the bolt through hole 240 is a penetrating hole, the second bolt hole 242 is a blind hole, and an inlet of the second bolt hole 242 is formed on one side close to the inserting-connection port 230. At this time, the bolt channel is a blind hole formed by the first bolt hole 241, the bridge block through hole 1131 and the second bolt hole 242.

Figure 9:
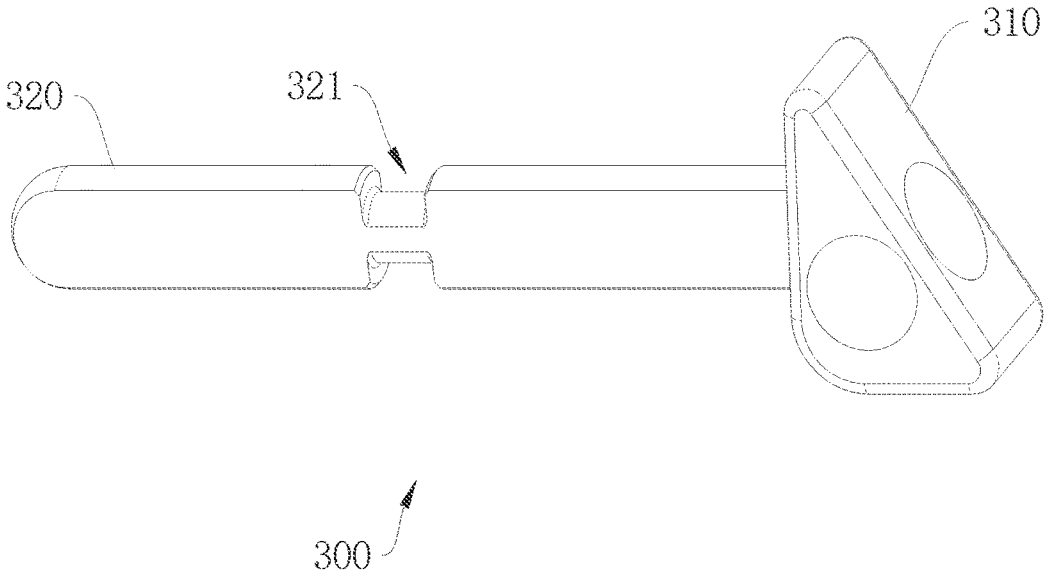
FIG. 9 is a structural schematic diagram of a bolt according to an embodiment of the present invention.

Referring to FIG. 9, the bolt 300 includes a bolt head 310 and a bolt rod 320, and a first end of the bolt rod 320 is fixedly connected to the bolt head 310. To facilitate the inserting operation of the bolt 300, an end part of a second end of the bolt rod 320 may be designed into an arc shape (as shown in the figure), or may be designed into a sharp shape.

Figure 10:
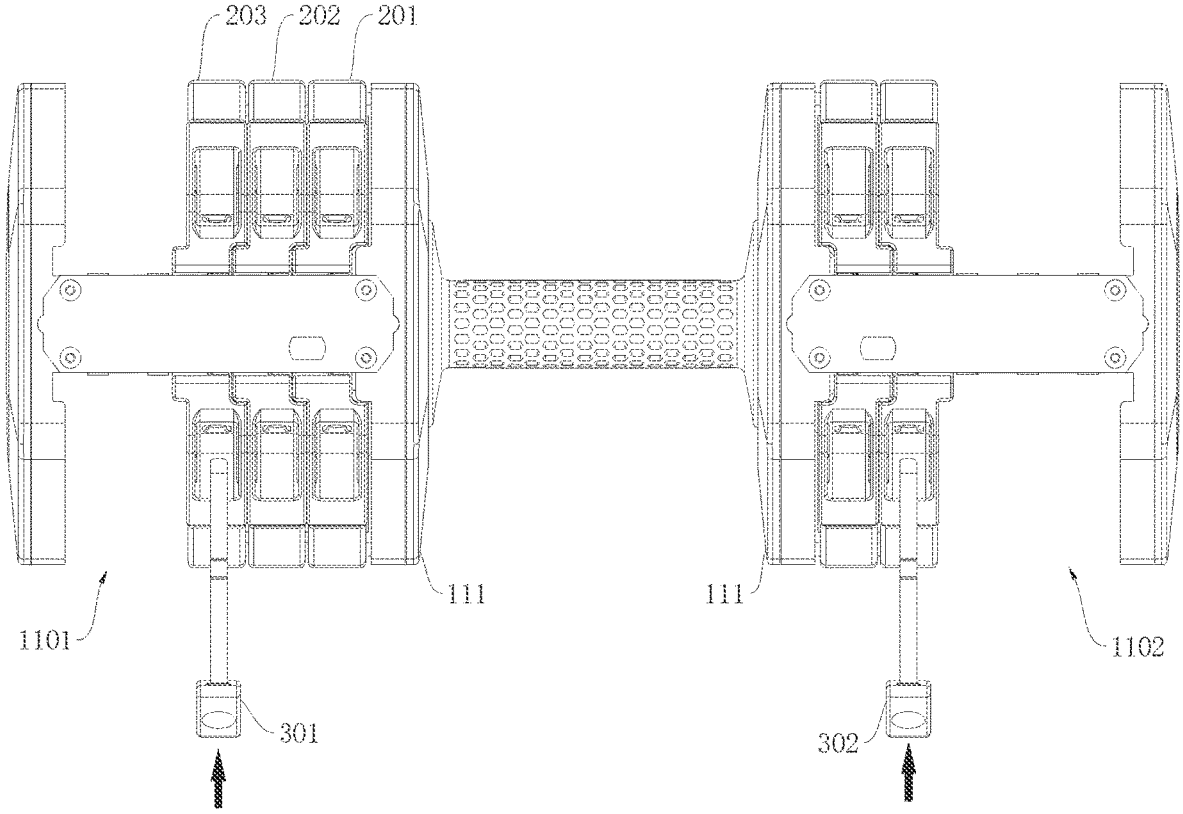
FIG. 10 is a schematic diagram of a hitching assembly hitched to a dumbbell plate according to an embodiment of the present invention.

Referring to FIG. 10, when the hitching assembly 110 hitches a plurality of dumbbell plates 200, the second surfaces 220 of the dumbbell plates 200 face towards the first baffle 111 and are sequentially attached to each other to be in inserting connection with the bridge block 113. For example, in the figure, a second surface 220 of a first dumbbell plate 201 is attached to the first baffle 111 of a left-side inserting-connection assembly and is in inserting connection with the bridge block 113, sequentially, a second surface 220 of a second dumbbell plate 202 is attached to the first surface 210 of the first dumbbell plate 201 and is in inserting connection with the bridge block 113, and a second surface 220 of the third dumbbell plate 203 is attached to the first surface 210 of the second dumbbell plate 202 and is in inserting connection with the bridge block 113. At this time, the first hitching part 211 of the first dumbbell plate 201 is hitched to the second hitching part 221 of the second dumbbell plate 202, and the first hitching part 211 of the second dumbbell plate 202 is hitched to the second hitching part 221 of the third dumbbell plate 203. Then, the first bolt 301 is inserted into the bolt through hole 240 of the third dumbbell plate 203 to hitch and fix the first dumbbell plate 201, the second dumbbell plate 202 and the third dumbbell plate 203. Similarly, the two dumbbell plates 200 may be hitched and fixed to a right-side hitching assembly 1102 through the second bolt 302.

In some embodiments, a mounting groove for accommodating the bolt head 310 is formed at a port of the bolt through hole 240 of the dumbbell plate 200, a shape of the mounting groove is matched with the bolt head 310, and the bolt head 310 may be completely mounted in the mounting groove. The objective is to prevent the protruding bolt head 310 from scratching the body or other objects when the dumbbell 1 is used. Furthermore, the outer side of the dumbbell plate 200 is flatter and more beautiful.

Further, a side wall of the mounting groove may be provided with a rib, so that the bolt head 310 can be tightened into the mounting groove, and the bolt 300 is more stable on the dumbbell 1 and is not easy to slide down.

In some embodiments, to temporarily store the bolt 300, a storage through hole 1132 is formed at the top of the hitching assembly 110. The bolt 300 may be inserted into the bridge block 113 through the storage through hole 1132 to achieve the temporary storage effect.

Figure 13:
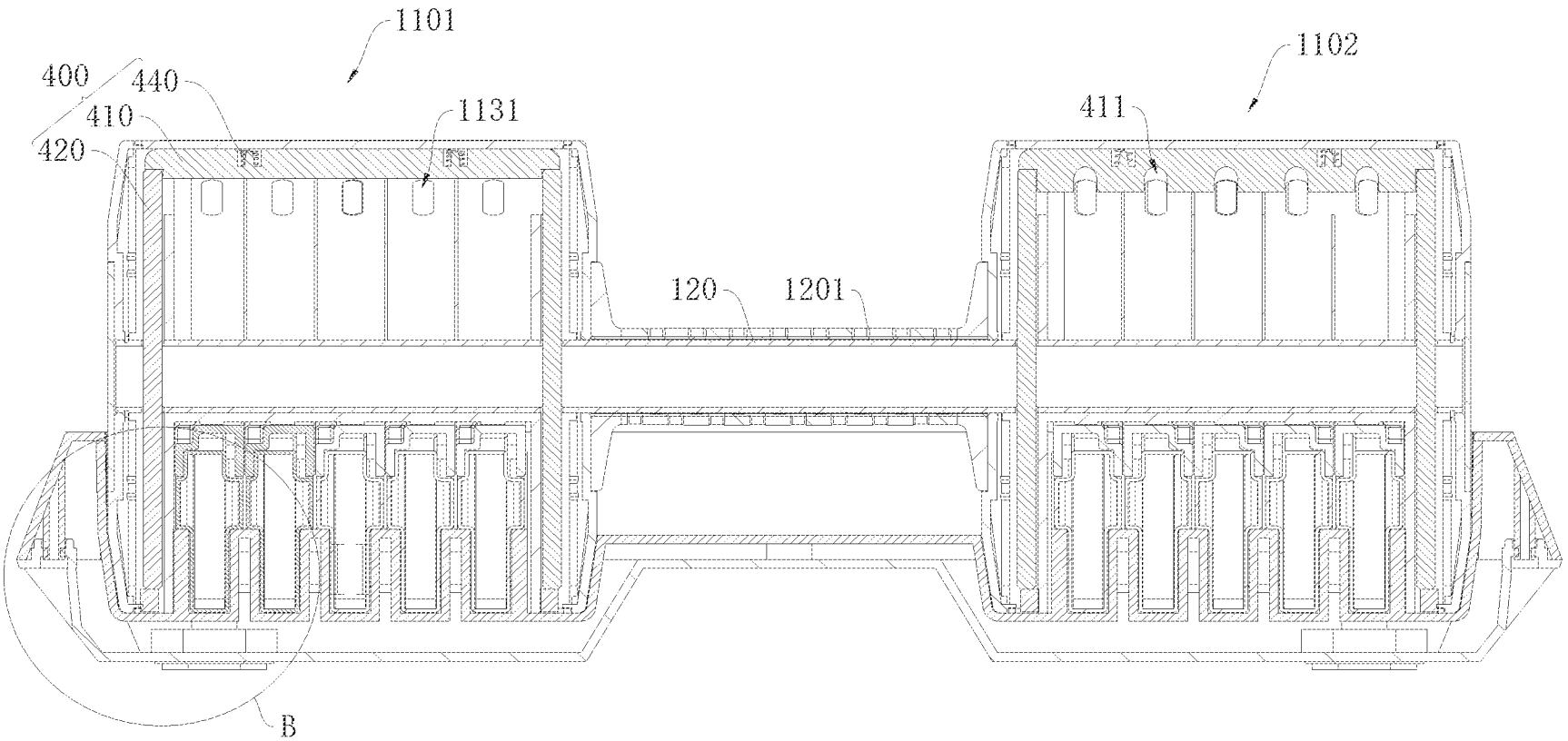
FIG. 13 is a schematic diagram of a sectional structure of a dumbbell assembly according to an embodiment of the present invention.

In some embodiments, referring to FIG. 13, a grip sleeve 1201 made of a soft material is sleeved at an outer side of a grip of the dumbbell rod 120. The grip sleeve 1201 not only conforms to ergonomics, but also has an anti-skid effect. Furthermore, the grip feeling of the grip can be improved, so that the grip is more comfortable.

Figure 11:
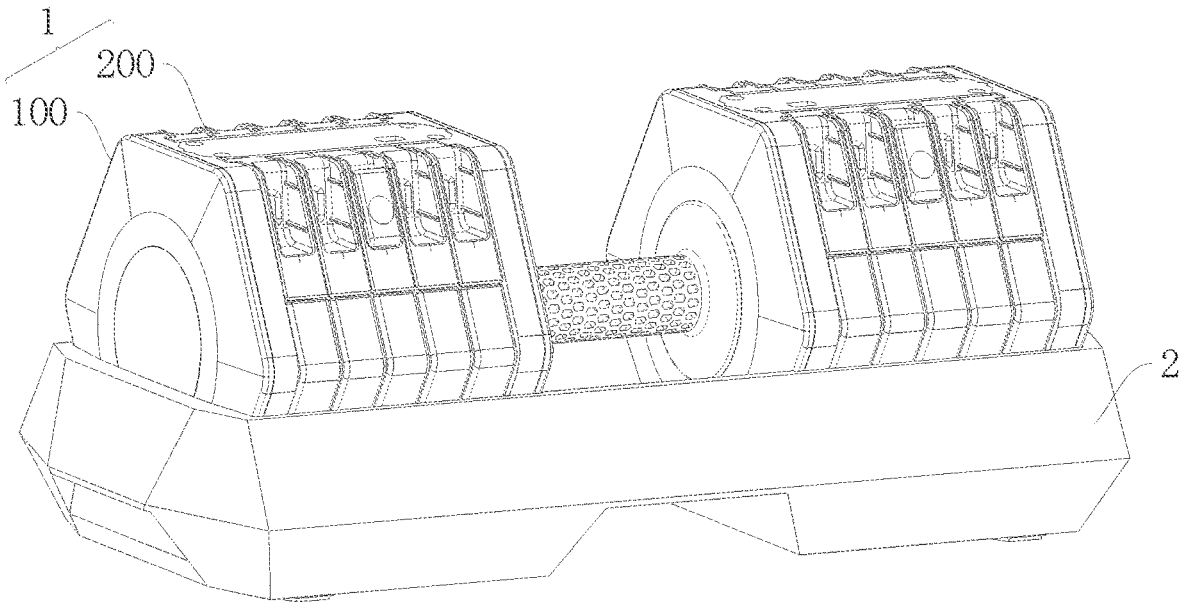
FIG. 11 is an overall structural schematic diagram of a dumbbell assembly according to an embodiment of the present invention.
Figure 12:
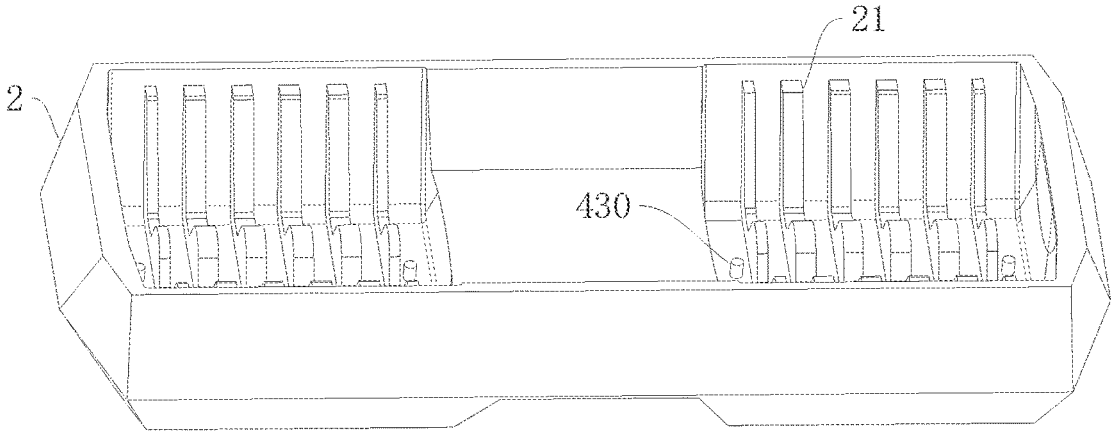
FIG. 12 is a structural schematic diagram of a tray according to an embodiment of the present invention.

The present disclosure further discloses a dumbbell 1 assembly, referring to FIG. 11 and FIG. 12, including the dumbbell 1, and a tray 2 for placing the dumbbell 1. A plurality of inserting-connection plates 21 parallel to each other are arranged at the top of the tray 2, a distance between the inserting-connection plate 21 is equivalent to a thickness of the dumbbell plate 200, and the dumbbell 200 can be vertically placed between the two adjacent inserting-connection plates 21.

Figure 4:
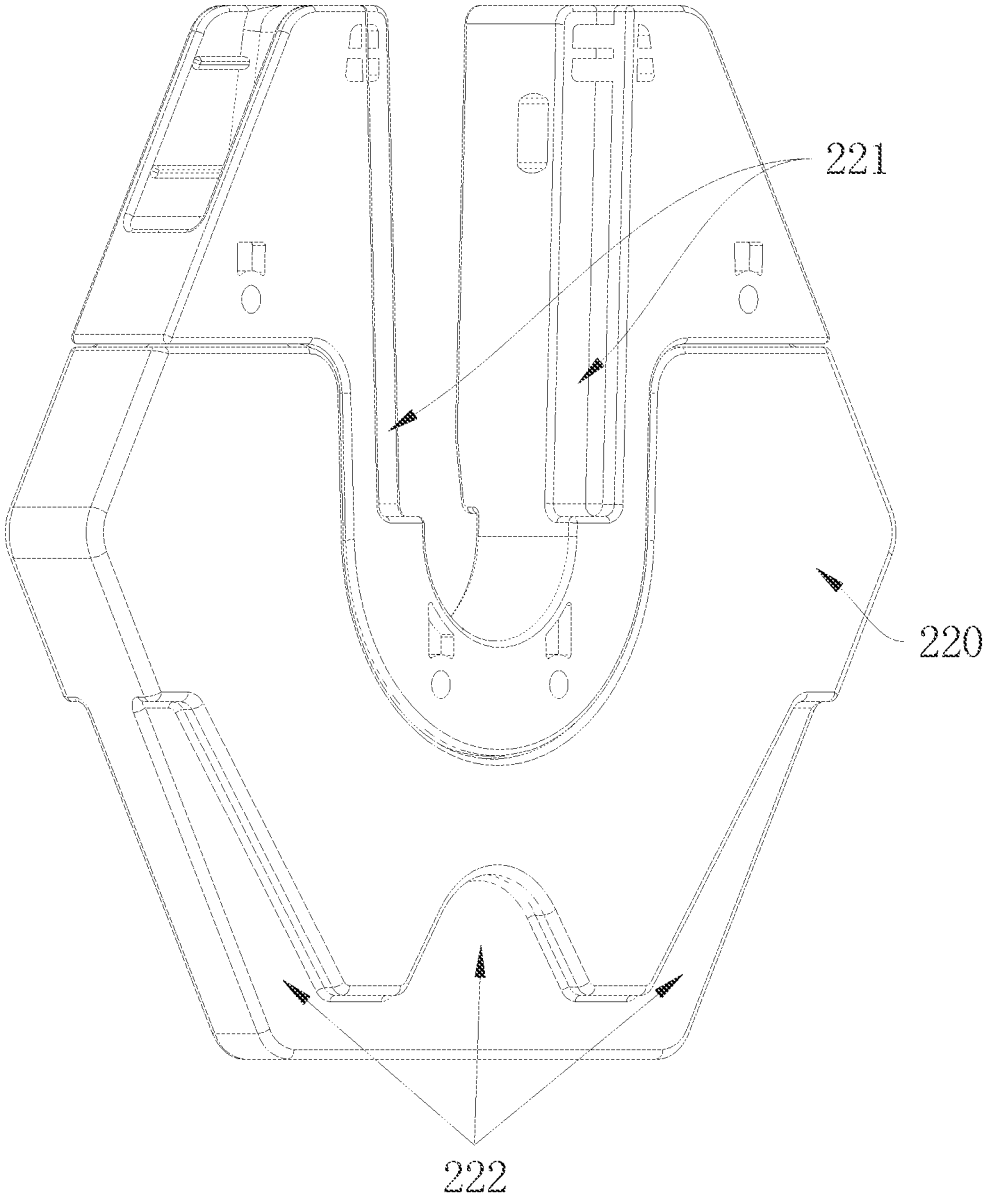
FIG. 4 is a three-dimensional structural schematic diagram of a second surface of a dumbbell plate according to an embodiment of the present invention.
Figure 5:
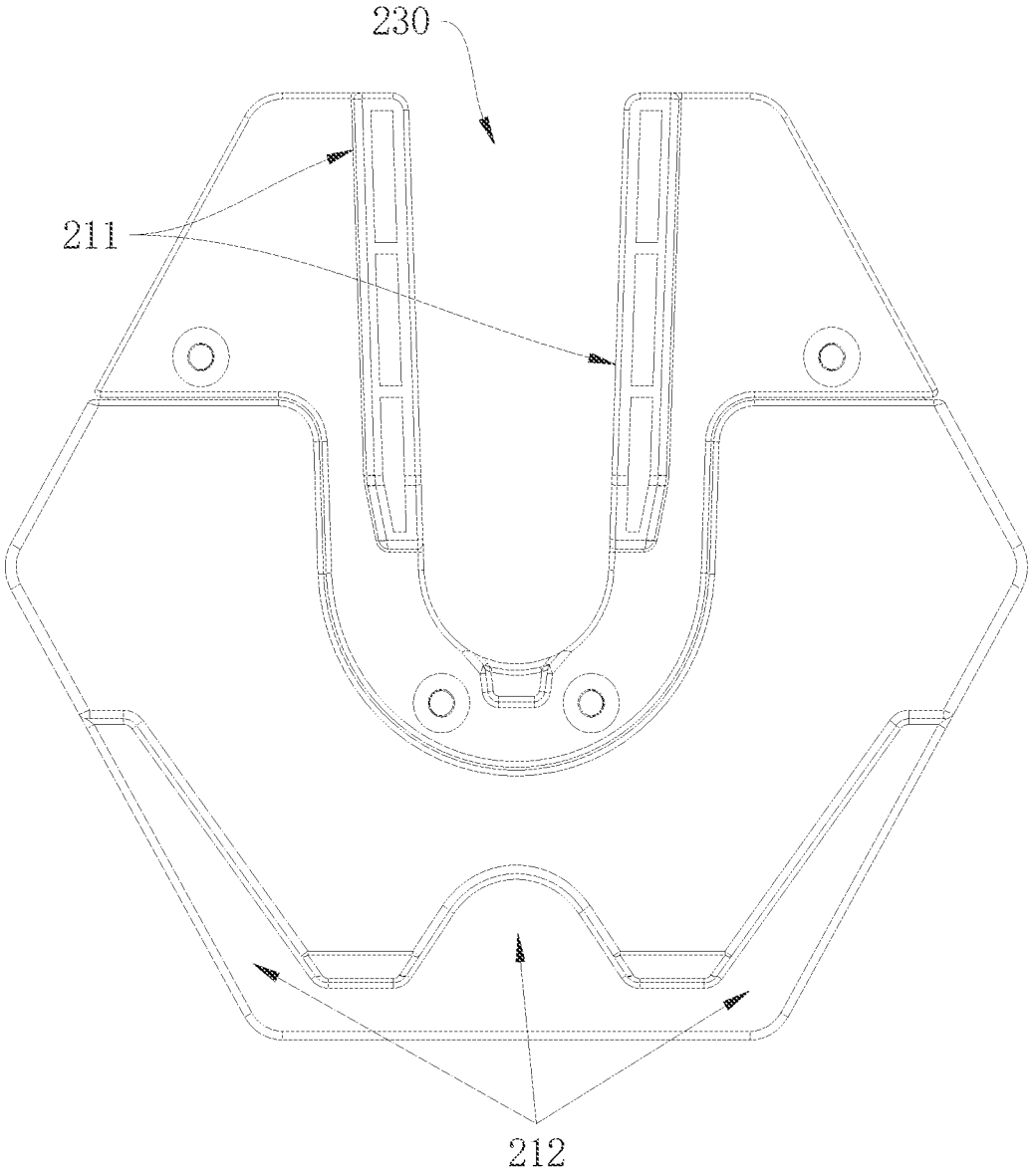
FIG. 5 is a front-view structural schematic diagram of a dumbbell plate according to an embodiment of the present invention.
Figure 6:
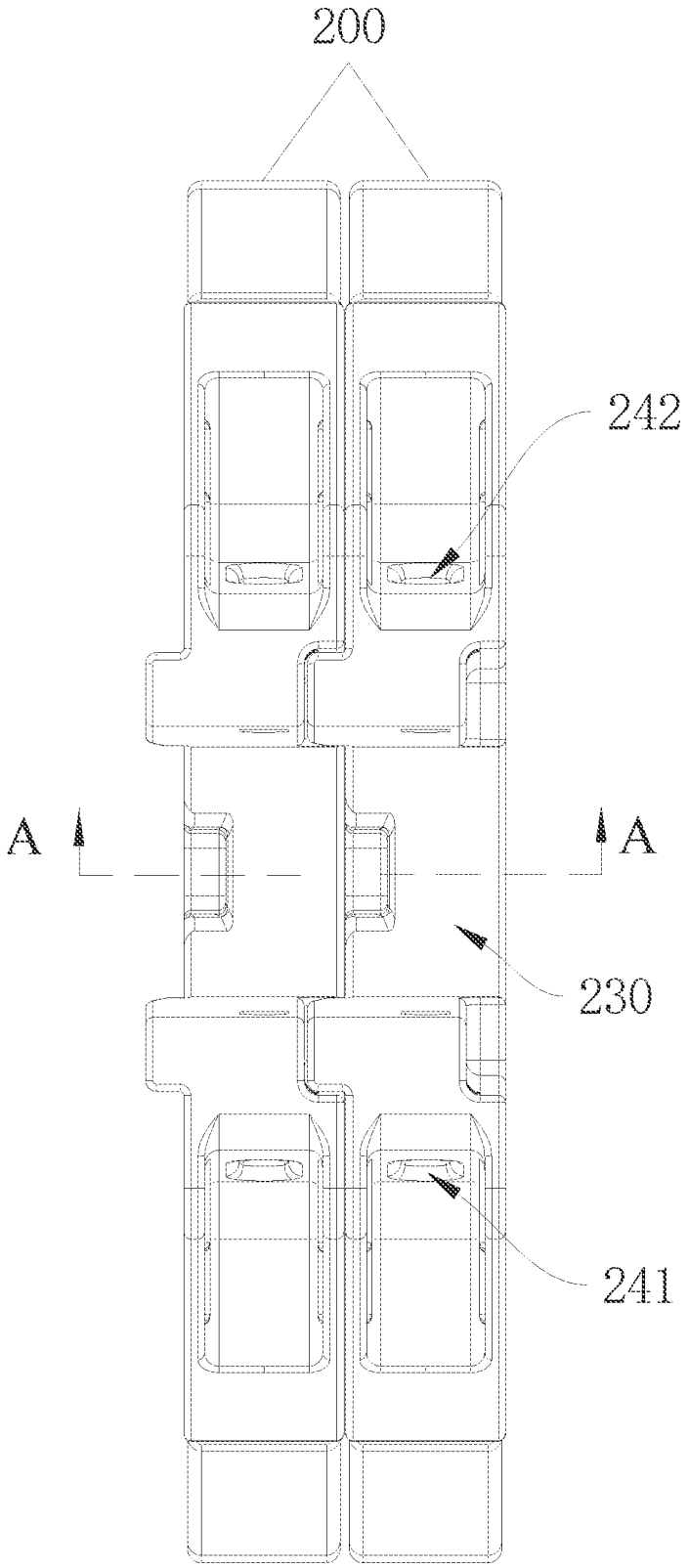
FIG. 6 is a hitching schematic diagram of two adjacent dumbbell plates according to an embodiment of the present invention.
Figure 7:
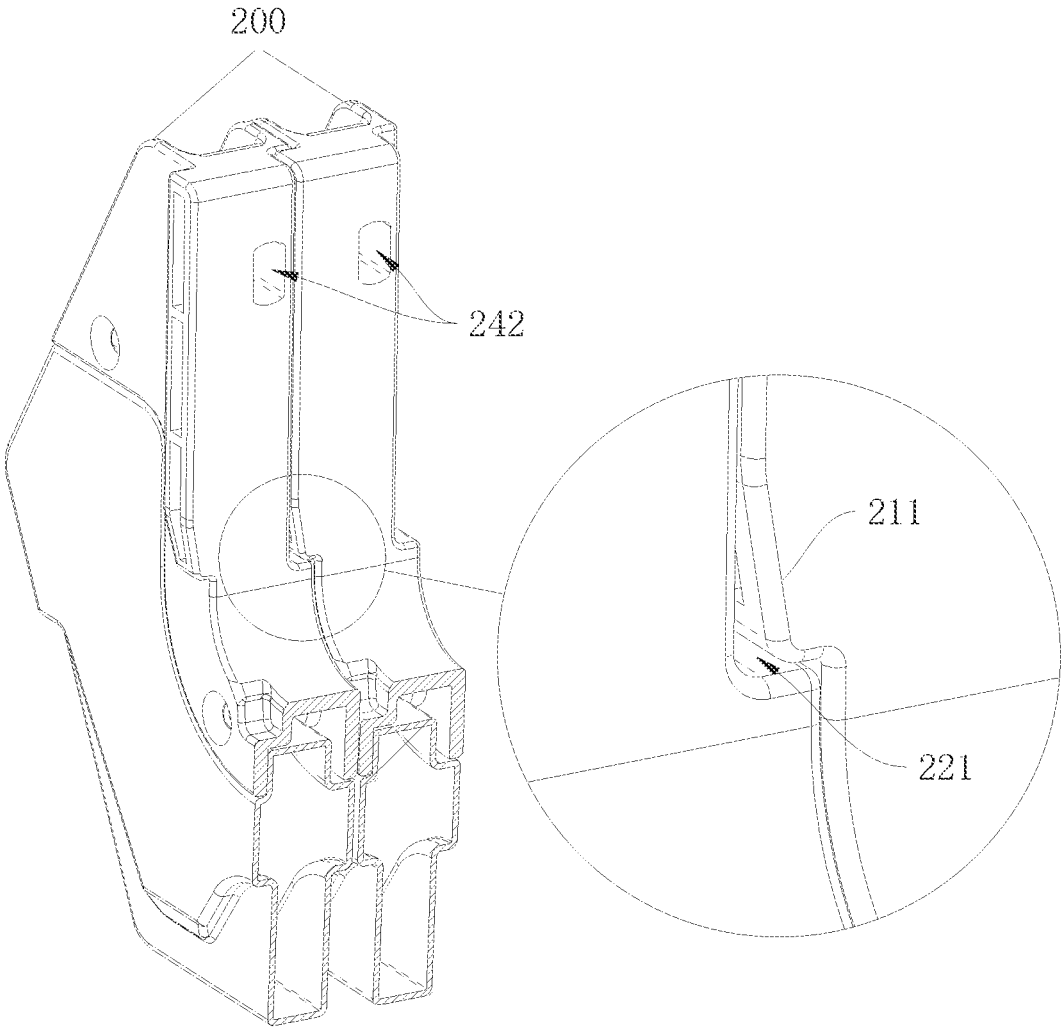
FIG. 7 is a sectional view in a direction AA of FIG. 6 and a partially enlarged schematic diagram according to an embodiment of the present invention.

In some embodiments, referring to FIG. 3 and FIG. 4, a special-shaped groove structure 212 is arranged at the bottom of the first surface 210 of the dumbbell plate 200, a special-shaped groove structure 222 is arranged at the bottom of the second surface 220, and a special-shaped protrusion structure matched with the groove structure is arranged at the top of the inserting-connection plate 21. When the dumbbell plate 200 is inserted in the two adjacent inserting-connection plates 21, the groove structures on two sides of the dumbbell plate 200 and the protrusion structure at the top of the inserting-connection plate 21 are matched with each other, so that the dumbbell plate 200 is erected at the top of the tray 2. The objective of the design is that the dumbbell plate 200 is erected at the top of the tray 2 more stably, the adjacent dumbbell plates 200 are attached to each other more tightly, and the dumbbell plate 200 is inserted into the tray 2 more easily.

Figure 14:
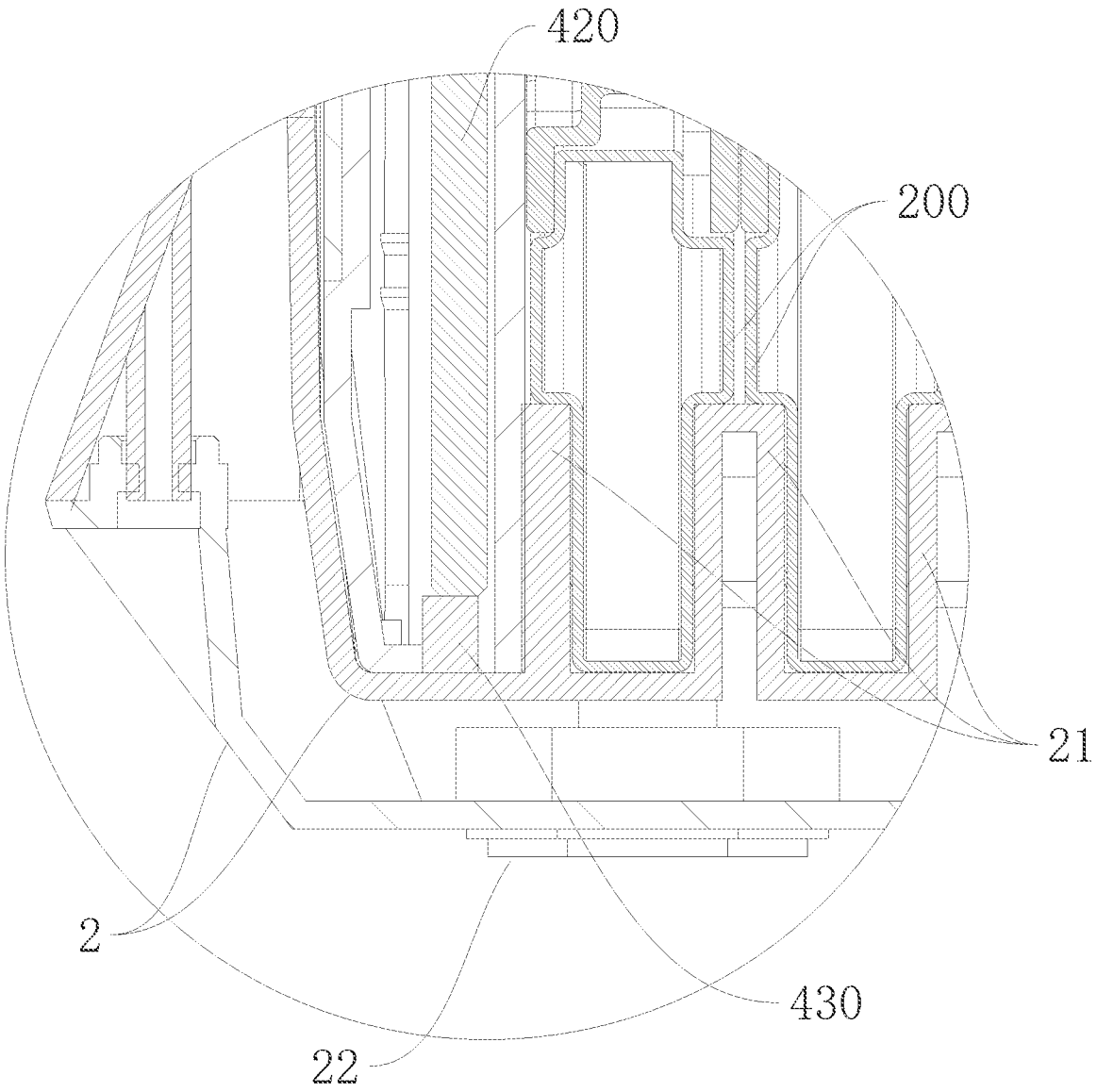
FIG. 14 is a partially enlarged schematic diagram of a position B of FIG. 13 according to an embodiment of the present invention.

In some embodiments, referring to FIG. 14, a plurality of anti-skid pads 22 made of a rubber material are arranged at the bottom of the tray 2, and are used for preventing the tray 2 from scratching the ground and preventing the tray 2 from sliding on the ground randomly when the tray 2 is placed on the ground.

During use of the dumbbell 1, to prevent the risk that the bolt 300 slides out and the dumbbell plate 200 falls off, the dumbbell rod assembly 100 is provided with a locking mechanism, and the bolt 300 and the hitching assembly 110 can be locked or released by the locking mechanism.

In this embodiment, the locking mechanism includes a limiting plate 410, and the limiting plate 410 is movably arranged in the hitching assembly 110. The locking mechanism further includes a limiting clamping port 321 arranged on the bolt rod 320 of the bolt 300. The locking mechanism achieves locking or releasing of the bolt 300 on the hitching assembly 110 through a clamping relationship between the limiting plate 410 and the limiting clamping port 321.

Specifically, referring to FIG. 12 to FIG. 14, the limiting plate 410 may be arranged at the top of an inner side of the bridge block 113 in an up-and-down movable manner, limiting rods 420 are arranged at two ends of the limiting plate 410, and first ends of the limiting rods 420 are fixedly connected to the limiting plate 410. The first baffle 111 and the second baffle 112 of the hitching assembly 110 are provided with channels capable of accommodating the limiting rods 420, and the limiting rods 420 may move in the channels freely. A first port of each of the channels penetrates through the bottom of the first baffle 111 or the second baffle 112, and a second port of each of the channels communicates with the bridge block 113. The limiting rods 420 at two ends of the limiting plate 410 are inserted into the corresponding channels, and second ends of the limiting rods 420 extend downwards to the first ports of the channels. A cover plate is arranged at the top of the bridge block 113, and a limiting spring 440 is arranged between the limiting plate 410 and the cover plate. A limiting protruding block 430 is arranged at the top of the tray 2, and the limiting protruding block 430 is matched with the first ports of the channels and can enter and exit the first ports of the channels.

Referring to FIG. 13, taking the left-side hitching assembly 1101 in the figure as an example, during use, firstly, the dumbbell plates 200 are sequentially attached to be inserted at the top of the tray 2. The hitching assembly 110 of the dumbbell rod assembly 100 is inserted into the inserting-connection port 230 of the dumbbell plate 200. In the falling process of the dumbbell rod assembly 100, the limiting protruding block 430 at the top of the tray 2 extends into the first port of the corresponding port, the limiting rod 420 is jacked by the limiting protruding block 430, the limiting plate 410 moves upwards accordingly, and the limiting spring 440 is compressed. A lower edge of the limiting plate 410 ascends above the bridge block through hole 1131, and the locking mechanism is in an unlocked state. The limiting plate 410 is located above the bridge block through hole 1131 at this time, so the limiting plate 410 does not interfere with the bolt 300, and the bolt 300 can enter and exit the bolt through hole 240 and the bridge block through hole 1131 randomly. A proper number of dumbbell plates 200 are selected, the bolts 300 are inserted into the corresponding dumbbell plates 200, the dumbbell plate 200 assembly is lifted, and the limiting protruding block 430 is separated from the first port of the corresponding channel. At this time, the limiting spring 440 relieves a pressure from the limiting protruding block 430, the limiting spring 440 is reset and rebounded, the limiting plate 410 moves under the action of the limiting spring 440 and is clamped at the limiting clamping port 321 of the bolt 300, and the locking structure is in a locked state. The bolt 300 is locked on the hitching assembly 110 under the action of the limiting clamping port 321 and the limiting plate 410, thereby avoiding accidents caused by the random sliding of the bolt 300.

Combining with the implementation solution of the locking mechanism and referring to FIG. 13, taking the right-side hitching assembly 1102 in the figure as an example, and an intersection of the limiting plate 410 and the bridge block through hole 1131 can be designed as a limiting groove 411 with an arc-shaped top. Correspondingly, a bottom surface of the limiting clamping port 321 of the bolt 300 is an arc-shaped surface. When the locking mechanism is in an unlocked state, the top of the limiting groove 411 is located above the bridge block through hole 1131, and the bolt 300 can randomly enter and exit the bolt through hole 240, the bridge block through hole 1131 and the limiting groove 411. When the locking mechanism is in a locked state, the top of the limiting groove 411 is clamped at the limiting port 321 of the bolt 300, and the bolt 300 is locked on the hitching assembly 110 under the action of the limiting clamping port 321 and the limiting plate 410. The scheme has the following advantages: when the locking mechanism is in the locked state, the top of the limiting groove 411 is arc-shaped and the bottom surface of the limiting clamping port 321 is an arc surface; and when the limiting groove 411 is in clamping connection with the limiting clamping port 321, the area of the clamping surface is larger, which is more conducive to the clamping stability.

In FIG. 13, the locking assemblies on two sides are not specifically limited, and the locking assembly on the left side and the locking assembly on the right side are only used for describing the structure, the position relationship and the connection relationship between the two locking assemblies.

The foregoing is merely a preferred embodiment of the present disclosure and is not intended to limit the present disclosure which may be subject to various modifications and variations to those skilled in the art. Any modification, equivalent replacement, improvement, etc. made within the spirit and principles of the present disclosure should be included in the scope of protection of the present invention.

What is claimed is:

1. A dumbbell capable of adjusting weight rapidly, comprising a dumbbell rod assembly and a plurality of dumbbell plates, wherein the dumbbell rod assembly comprises a dumbbell rod; a concave inserting-connection port is formed at a top of each of the plurality of dumbbell plates;

each of the plurality of dumbbell plates comprises a first surface and a second surface which are arranged oppositely, the first surface is provided with at least one first hitching part, the second surface is provided with a second hitching part hitched to and matched with the at least one first hitching part, and a first bolt hole and a second bolt hole are formed at the top of each of the plurality of dumbbell plates and on two sides of the concave inserting-connection port;

the dumbbell rod assembly further comprises hitching assemblies arranged at two ends of the dumbbell rod; each of the hitching assemblies comprises a bridge block, the bridge block is matched with the concave inserting-connection port of each of the plurality of dumbbell plates, one end of the bridge block is fixedly connected to a first baffle, a plurality of bridge block through holes are formed at a top of the bridge block, and after each of the plurality of dumbbell plates is in inserting connection with the bridge block, the first bolt hole, the second bolt hole and the corresponding bridge block through hole form a bolt channel; and the dumbbell further comprises at least one bolt inserted into the bolt channel and hitching a corresponding one of the plurality of dumbbell plates to the hitching assembly;

the dumbbell further comprises a locking mechanism; the locking mechanism comprises a limiting plate arranged in each of the hitching assemblies, and a limiting clamping port arranged on a bolt rod of the at least one bolt; and the locking mechanism enables the at least one bolt to be locked or released on each of the hitching assemblies through a clamping relationship between the limiting plate and the limiting clamping port.

2. The dumbbell according to claim 1, wherein the at least one bolt comprises a bolt head and a bolt rod, and a first end of the bolt rod is fixedly connected to the bolt head.

3. The dumbbell according to claim 2, wherein a mounting groove for accommodating the bolt head is formed at an outer port of the first bolt hole or the second bolt hole of each of the plurality of dumbbell plates, and a shape of the mounting groove is matched with a shape of the bolt head, so that the bolt head is mountable in the mounting groove.

4. The dumbbell according to claim 1, wherein the first hitching part is arranged on at least one side of the concave inserting-connection port of the first surface of each of the plurality of dumbbell plates.

5. The dumbbell according to claim 1, wherein the first hitching part is a convex strip formed by the first surface extending outwards;

the second hitching part is a groove formed by the second surface extending inwards, and a first end of the groove in a length direction extends upwards to a top surface of each of the plurality of dumbbell plates; and when two adjacent dumbbell plates of the plurality of dumbbell plates are hitched, the convex strip of one dumbbell plate of the two adjacent dumbbell plates is embeddable into the groove of another dumbbell plate of the two adjacent dumbbell plates, and a second end of the convex strip in a length direction abuts against a second end of the groove in the length direction.

6. The dumbbell according to claim 1, wherein a storage through hole is formed at a top of each of the hitching assemblies, and the at least one bolt is inserted into the bridge block through the storage through hole for storage of the at least one bolt; or/and a grip sleeve is sleeved on an outer side of a grip of the dumbbell rod.

7. The dumbbell according to claim 1, wherein a limiting rod is arranged at at least one of two ends of the limiting plate, a first end of the limiting rod is fixedly connected to the limiting plate, and a second end of the limiting rod vertically penetrates through each of the hitching assemblies.

8. A dumbbell assembly, comprising:

a dumbbell rod assembly and a plurality of dumbbell plates, wherein the dumbbell rod assembly comprises a dumbbell rod; a concave inserting-connection port is formed at a top of each of the plurality of dumbbell plates;

each of the plurality of dumbbell plates comprises a first surface and a second surface which are arranged oppositely, the first surface is provided with at least one first hitching part, the second surface is provided with a second hitching part hitched to and matched with the at least one first hitching part, and a first bolt hole and a second bolt hole are formed at the top of each of the plurality of dumbbell plates and on two sides of the concave inserting-connection port;

the dumbbell rod assembly further comprises hitching assemblies arranged at two ends of the dumbbell rod; each of the hitching assemblies comprises a bridge block, the bridge block is matched with the concave inserting-connection port of each of the plurality of dumbbell plates, one end of the bridge block is fixedly connected to a first baffle, a plurality of bridge block through holes are formed at a top of the bridge block, and after each of the plurality of dumbbell plates is in inserting connection with the bridge block, the first bolt hole, the second bolt hole and the corresponding bridge block through hole form a bolt channel; and the dumbbell assembly further comprises at least one bolt inserted into the bolt channel and hitching a corresponding one of the plurality of dumbbell plates to the hitching assembly, and a tray for placing the dumbbell assembly;

wherein groove structures are arranged at bottoms of the first surface and the second surface of each of the plurality of dumbbell plates;

a plurality of inserting-connection plates are arranged at a top of the tray, and protruding structures matched with the groove structures are arranged at a top of each of the plurality of inserting-connection plates; and each of the plurality of dumbbell plates is inserted between two adjacent inserting-connection plates of the plurality of inserting-connection plates.

9. The dumbbell assembly according to claim 8, wherein the dumbbell assembly is provided with a locking mechanism;

the locking mechanism comprises a limiting plate arranged in each of the hitching assemblies, and a limiting clamping port arranged on a bolt rod of the at least one bolt; and the locking mechanism enables the at least one bolt to be locked or released on each of the hitching assemblies through a clamping relationship between the limiting plate and the limiting clamping port.

10. The dumbbell assembly according to claim 9, wherein a limiting rod is arranged at at least one of two ends of the limiting plate, a first end of the limiting rod is fixedly connected to the limiting plate, and a second end of the limiting rod vertically penetrates through each of the hitching assemblies; and a limiting protruding block corresponding to the limiting rod is arranged at the top of the tray, and the locking mechanism is locked or released through the cooperation of the limiting protruding block and the limiting rod.

11. The dumbbell assembly according to claim 8, wherein the at least one bolt comprises a bolt head and a bolt rod, and a first end of the bolt rod is fixedly connected to the bolt head.

12. The dumbbell assembly according to claim 11, wherein a mounting groove for accommodating the bolt head is formed at an outer port of the first bolt hole or the second bolt hole of each of the plurality of dumbbell plates, and a shape of the mounting groove is matched with a shape of the bolt head, so that the bolt head is mountable in the mounting groove.

13. The dumbbell assembly according to claim 8, wherein the first hitching part is arranged on at least one side of the concave inserting-connection port of the first surface of each of the plurality of dumbbell plates.

14. The dumbbell assembly according to claim 8, wherein the first hitching part is a convex strip formed by the first surface extending outwards;

the second hitching part is a groove formed by the second surface extending inwards, and a first end of the groove in a length direction extends upwards to a top surface of each of the plurality of dumbbell plates; and when two adjacent dumbbell plates of the plurality of dumbbell plates are hitched, the convex strip of one dumbbell plate of the two adjacent dumbbell plates is embeddable into the groove of another dumbbell plate of the two adjacent dumbbell plates, and a second end of the convex strip in a length direction abuts against a second end of the groove in the length direction.

15. The dumbbell assembly according to claim 8, wherein a storage through hole is formed at a top of each of the hitching assemblies, and the at least one bolt is inserted into the bridge block through the storage through hole for storage of the at least one bolt; or/and a grip sleeve is sleeved on an outer side of a grip of the dumbbell rod.

* * * * *